US006905188B1

(12) United States Patent
Teape et al.

(10) Patent No.: US 6,905,188 B1
(45) Date of Patent: Jun. 14, 2005

(54) EJECTION APPARATUS FOR PRINTHEAD

(75) Inventors: John William Teape, Cambridge (GB); Guy Charles Fernley Newcombe, Cambridge (GB); Daniel Richard Mace, Cambridge (GB); Philip John Atkin, Cambridge (GB)

(73) Assignee: Tonejet Corporation Pty. Ltd., Eastwood (AU)

( * ) Notice: Subject to any disclaimer, the term of this patent is extended or adjusted under 35 U.S.C. 154(b) by 0 days.

(21) Appl. No.: 10/110,530

(22) PCT Filed: Oct. 25, 2000

(86) PCT No.: PCT/GB00/04121

§ 371 (c)(1),
(2), (4) Date: Apr. 15, 2002

(87) PCT Pub. No.: WO01/30576

PCT Pub. Date: May 3, 2001

(30) Foreign Application Priority Data

Oct. 25, 1999 (EP) ..... 99308383

(51) Int. Cl.[7] ..... B41J 2/015; B41J 2/145

(52) U.S. Cl. ..... 347/20; 347/40; 347/50; 347/112

(58) Field of Search ..... 347/20, 40, 50, 347/112, 55; B41J 2/015, 2/145, 2/41, 2/205, 2/14, 2/16, 2/06

(56) References Cited

U.S. PATENT DOCUMENTS 5,502,472 A * 3/1996 Suzuki ..... 347/69
5,625,393 A * 4/1997 Asai ..... 347/69
5,646,661 A * 7/1997 Asai et al. ..... 347/69
5,969,732 A * 10/1999 Suetsugu ..... 347/55
6,059,399 A * 5/2000 Suetsugu et al. ..... 347/55
6,079,817 A * 6/2000 Shima et al. ..... 347/55
6,106,106 A * 8/2000 Nakazawa et al. ..... 347/68
6,161,922 A * 12/2000 Shima et al. ..... 347/55
6,168,264 B1 * 1/2001 Yoshihira et al. ..... 347/65
6,260,954 B1 * 7/2001 Lima-Marques ..... 347/55

FOREIGN PATENT DOCUMENTS

EP 0 760 290 3/1997
EP 0 822 075 2/1998
EP 822075 A2 * 2/1998 ..... B41J/2/06
WO WO 97/27058 7/1997
WO WO 9727058 A1 * 7/1997 ..... B41J/2/06

* cited by examiner

*Primary Examiner*—Lamson Nguyen
*Assistant Examiner*—Leonard Liang
(74) *Attorney, Agent, or Firm*—Dykema Gossett PLLC

(57) ABSTRACT

An ejection apparatus for ejecting material from a liquid at a plurality of ejection locations (4) disposed in a row, has a plurality of channels (11) through each of which liquid flows in use to or from a respective ejection location at an open end of the channel. An ejection electrode (7) is disposed at each ejection location by means of which an electric field is created in use to cause the ejection of material from the liquid. An electrically conductive path (12) exists to each ejection electrode for supplying a voltage to the ejection electrode (7) in use. The channels (11) are isolated from one another and the electrically conductive paths (12) are separated from the channels over substantially the whole of their length.

23 Claims, 5 Drawing Sheets

EJECTION APPARATUS FOR PRINTHEAD

The present invention relates to apparatus for ejecting material from a liquid and, more particularly, to an apparatus in which the method employed is generally of the type described in WO-A-93-11866, the disclosure of which is incorporated herein by reference. In the above patent specification an agglomeration or concentration of particles is achieved in the printhead and, from the ejection location, the agglomeration of particles is then ejected onto a substrate, e.g. for printing purposes.

In the case of an array printer, plural cells each containing an ejection location, may be arranged in one or more rows. The present invention is directed towards novel constructions of such apparatus to improve operation and enhance operability, and in this regard, reference is made to our prior publications WO-A-97-27058, WO-A-97-27056, WO-A-97-27057 and WO-A-98-32609.

In those prior patent specifications there is disclosure of an array printer in which a plurality of adjacent cells are formed between a series of separating lands. Within each cell a further land carries an ejection upstand which provides the ejection location for the material. As shown, for example, in FIG. 2 of WO-A-98-32609, side covers extend across the tops of each of the cells to close the tops. Behind the side covers fluid which is fed to the printhead is held in a form of reservoir or manifold and flows into the individual cells adjacent to the ejection location, depending upon the volume of ejection from a particular ejection location/cell.

The ejection mechanism of printers of this type, being at least partly electrostatic, and relying partly therefore on repulsion of the particles from the ejection location, may result in a tendency for pigment particles (say in a pigmented ink) to flow away from a cell from which ejection occurs to an adjacent cell from which ejection is not occurring, by the mechanism of electrophoresis. A further difficulty lies in the tendency of charged particles in the electric field to impinge on surfaces of the electrodes, as a result of electrophoresis. Although the shear forces created by flow through such channels may act to dislodge particles from the surfaces, the shear force needs to be greater than the electrophoretic force and the charged particles need to be moved away from the electric field before other particles impinge on them. In order to improve print performances and long term printhead reliability, it would be desirable to reduce or eliminate the unwanted effects of electrophoretic particle flow in the channels. In order to minimise the effects of the electrophoretic force one solution proposed in U.S. Pat. No. 5,754,199, is to drive the electrodes adjacent to the ejecting electrode high first to force additional ink particles towards the ejecting electrode by means of electrophoresis. The object of this is to pre-compensate for the fact that when a drive signal is applied to the ejection electrode, ink particles will migrate away from the active electrode. This proposed approach will limit the printing speed.

According to the present invention there is provided an ejection apparatus for ejecting material from a liquid at a plurality of ejection locations, the apparatus comprising a printhead having a plurality of channels through each of which liquid flows in use to or from a respective ejection location at an open end of the channel, each channel being one of two co-operating channels, one of which supplies liquid to a respective ejection location and the other of which removes depleted liquid from the same ejection location, the channels thus having a common open end, an ejection electrode disposed at each ejection location and by means of which an electric field is created in use to cause the ejection of material from the liquid, and an electrically conductive path to each ejection electrode for supplying a voltage to the ejection electrode in use, characterised in that the channels are isolated from one another and separated from the electrically conductive paths over substantially the whole of the length of the electrically conductive paths.

In the printhead design disclosed in WO 97/27058, the ink channels can communicate with each other over most of their length. Also according to this design the electrodes communicate with the ink over the full ink path in the channel. A consequence of this construction is that an electrophoretic force acts on the ink particles that drives them towards the electrodes. If a sufficiently high fluid flow rate could be used then the shear force would be sufficiently high to prevent particles beginning to build up on the electrode structure. However, it would not be practical to use such a high flow rate. The present invention provides a better solution in that by ensuring that the channels are isolated from one another; and the electrically conductive paths are separated from the channels over substantially the whole of the length of the channels, the electrophoretic force is reduced and therefore a lower shear force is required to prevent particles from building up on the electrodes. Since a lower shear force is required the velocity of the flow can be reduced. The present invention also achieves the object of U.S. Pat. No. 5,754,199 without requiring complex drive signals that, as stated earlier, will limit the print speed.

By this construction, the electrically conductive paths can be isolated from the channels except in the immediate vicinity of the ejection locations, which isolation serves to reduce or prevent electrophoretic effects causing a build-up of particles on the channel walls which would otherwise act to reduce the flow of material to the ejection locations.

Each channel is preferably one of a pair of co-operating channels, one of which supplies liquid to a respective ejection location and the other of which removes depleted liquid from the same ejection location, the channels of each pair thus having a common open end. The channels of each pair may have longitudinal axes which are disposed at an angle to one another so that liquid is brought to the ejection location and removed from it from the sides, the electrically conductive paths being provided substantially along a central axis bisecting the axes of the channels. The channels may be formed along the edges of a pair of prismatic bodies separate from a component which forms the ejection locations.

Preferably, the individual channels are separated from one another by a plurality of walls and isolation of the individual channels is achieved by closing the tops of the channels over a majority of their length, preferably by means of a pair of side covers, each of which is common to all of the channels on a respective side and which engages the walls.

At the open end of the channels, lands separate the ejection locations from one another. Protrusions preferably form the ejection locations and are also defined by lands between the lands which separate individual ejection locations from one another, the protrusions of the ejection location-defining lands being smaller in width and defining, on each side thereof, passages for liquid flow between the ejection location-separating lands. In order to separate the ejection location-defining lands from the ejection location-separating lands, spacers may be provided on the flanks of the ejection location-defining lands at least over most of their length, the separators being formed integrally with the protrusion-defining lands, the channel-separating lands or both. The lands and separators are preferably formed by a component located between the prismatic bodies in which the channels are formed.

By this construction, each channel may be of increased length in comparison with the prior designs mentioned above and by providing side covers which close the individual channels, fluid separation between them is provided.

Preferably, the separators are metallised to provide the electrically conducting paths to the ejection electrodes.

Preferably, each electrically conductive path is disposed so as to be out of contact with the liquid, in use, over substantially the whole of its length. Each electrically conductive path may be disposed so as to be in contact with the liquid, in use, solely at the region of the corresponding ejection location.

One example of an apparatus according to the present invention will now be described with reference to the accompanying drawings in which.

Figure 1:
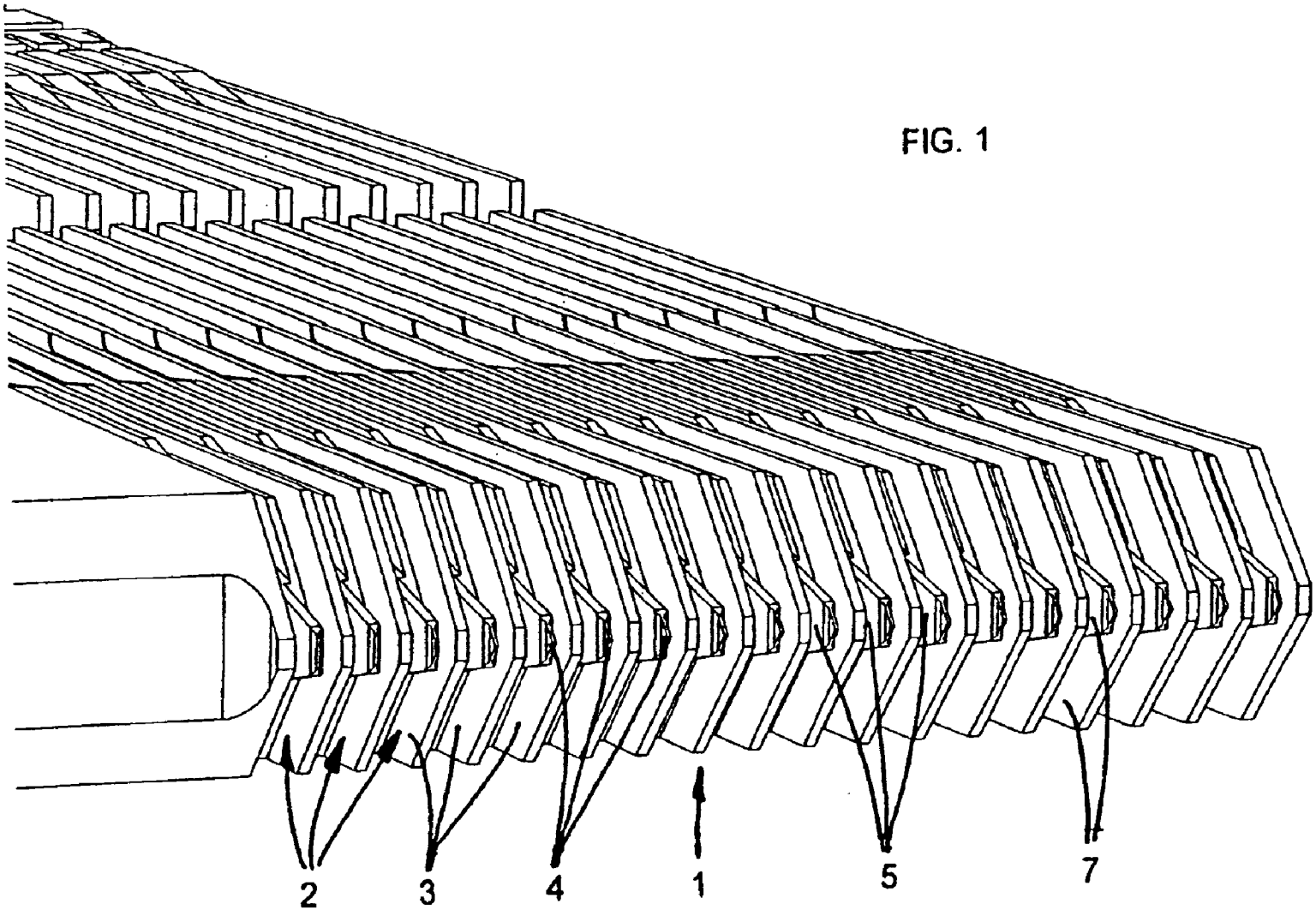
FIG. 1 is a perspective view, from the front and one side, of part of an ink jet printhead.
Figure 2:
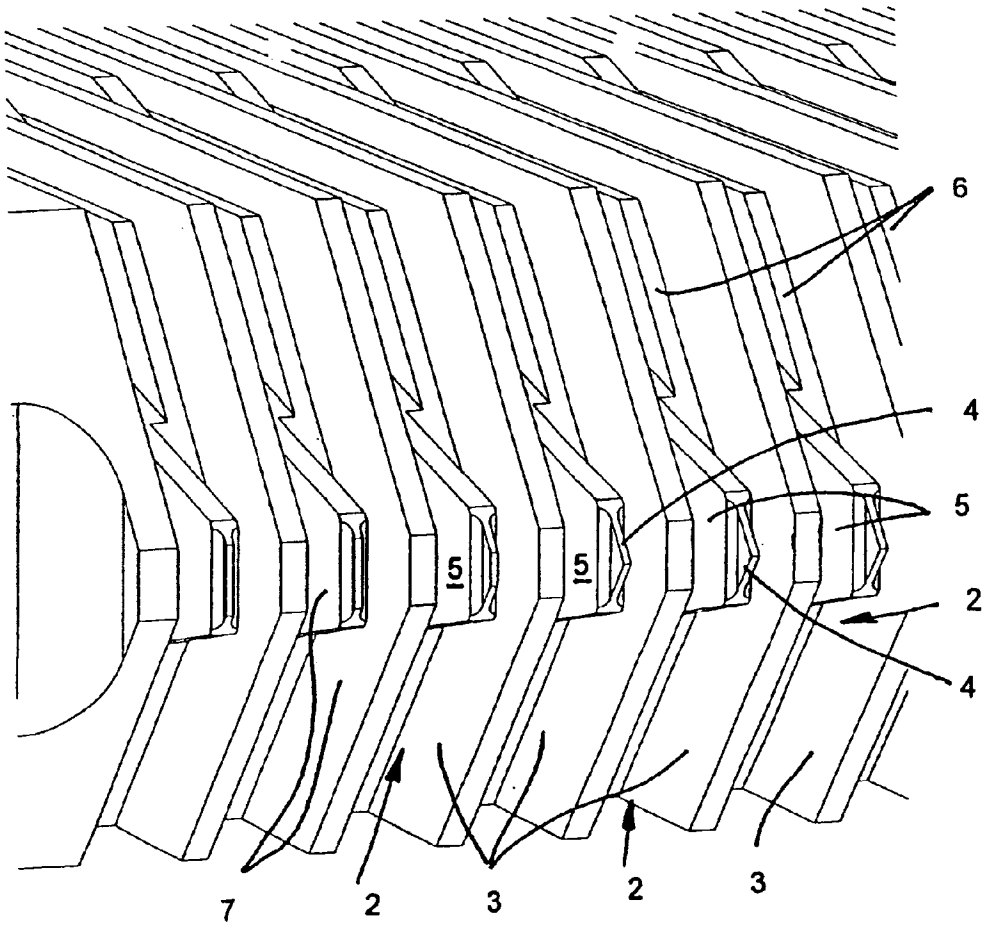
FIG. 2 is a perspective view, again from the front, in close-up.

FIGS. 1 and 2 illustrate the construction of the individual cells 2 of a printhead 1, individual cells 2 being separated by separating lands 3 and each cell including an ejection location defined by a protrusion 4 formed at the end of a corresponding land 5 disposed substantially centrally between the cell-defining or ejection location/cell-separating lands 3 on each side.

Figure 3:
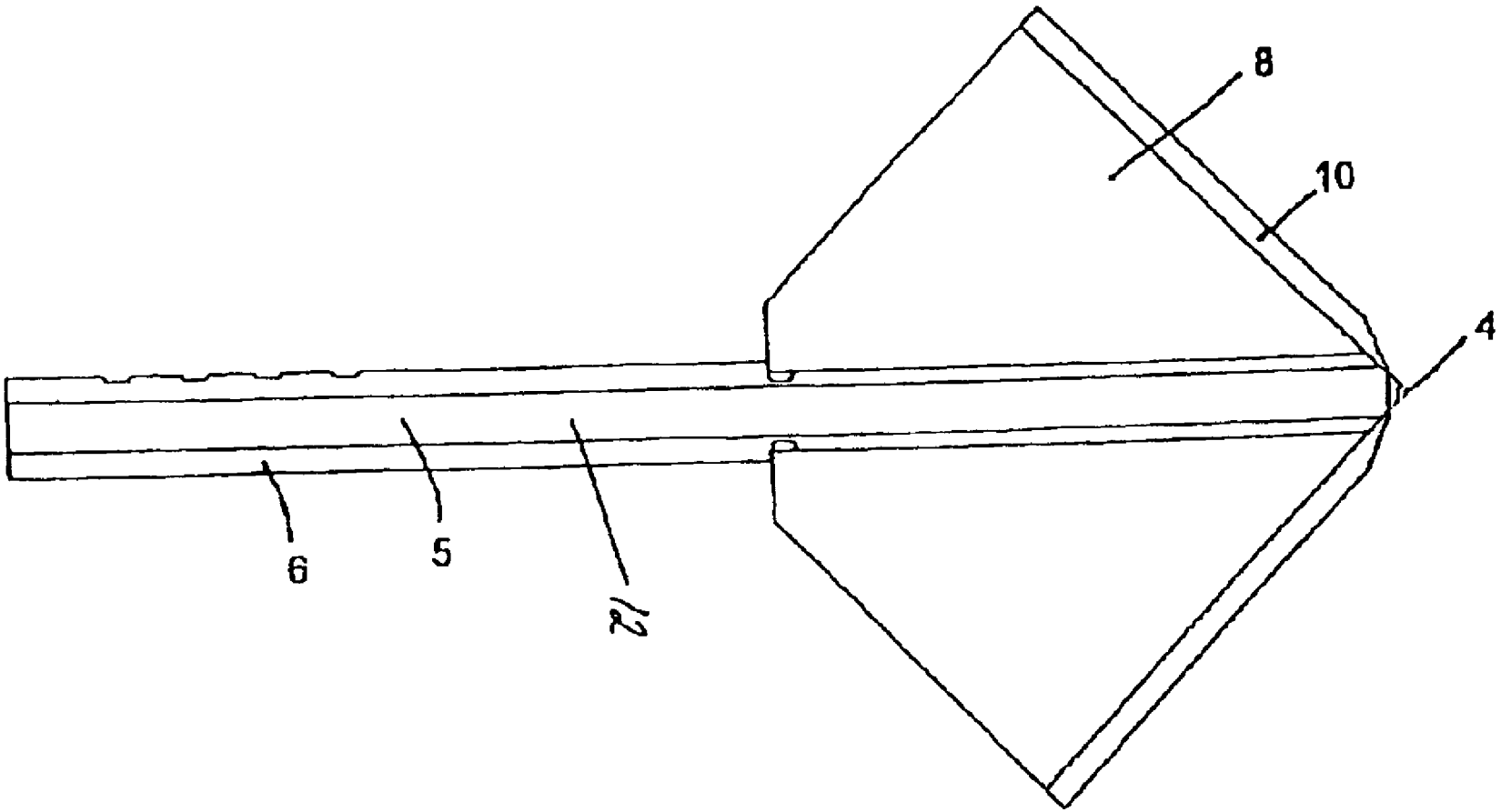
FIG. 3 is a longitudinal section through the printhead.

Ejection electrodes 7 are formed by selective metallisation of surfaces of the cell-separating and protrusion-forming lands 3,5. Each of the protrusion-supporting lands 5 is separated from the adjacent cell-separating lands by a spacer 6 (only one of which can be seen in each cell 2 in FIGS. 1 and 2, because of the perspective), the surface of each spacer likewise being metallised to provide an electrically conductive path or track 12 to the respective ejection electrodes 7 from the rear of the printhead (best seen in FIG. 3).

As is clearly seen from FIGS. 1 and 2, at the front of each cell the lands 5 are tapered at an acute angle and support the ejection location protrusion 4 at their front edge, the cell-separating lands 3 being tapered at a larger angle as shown.

Figure 4:
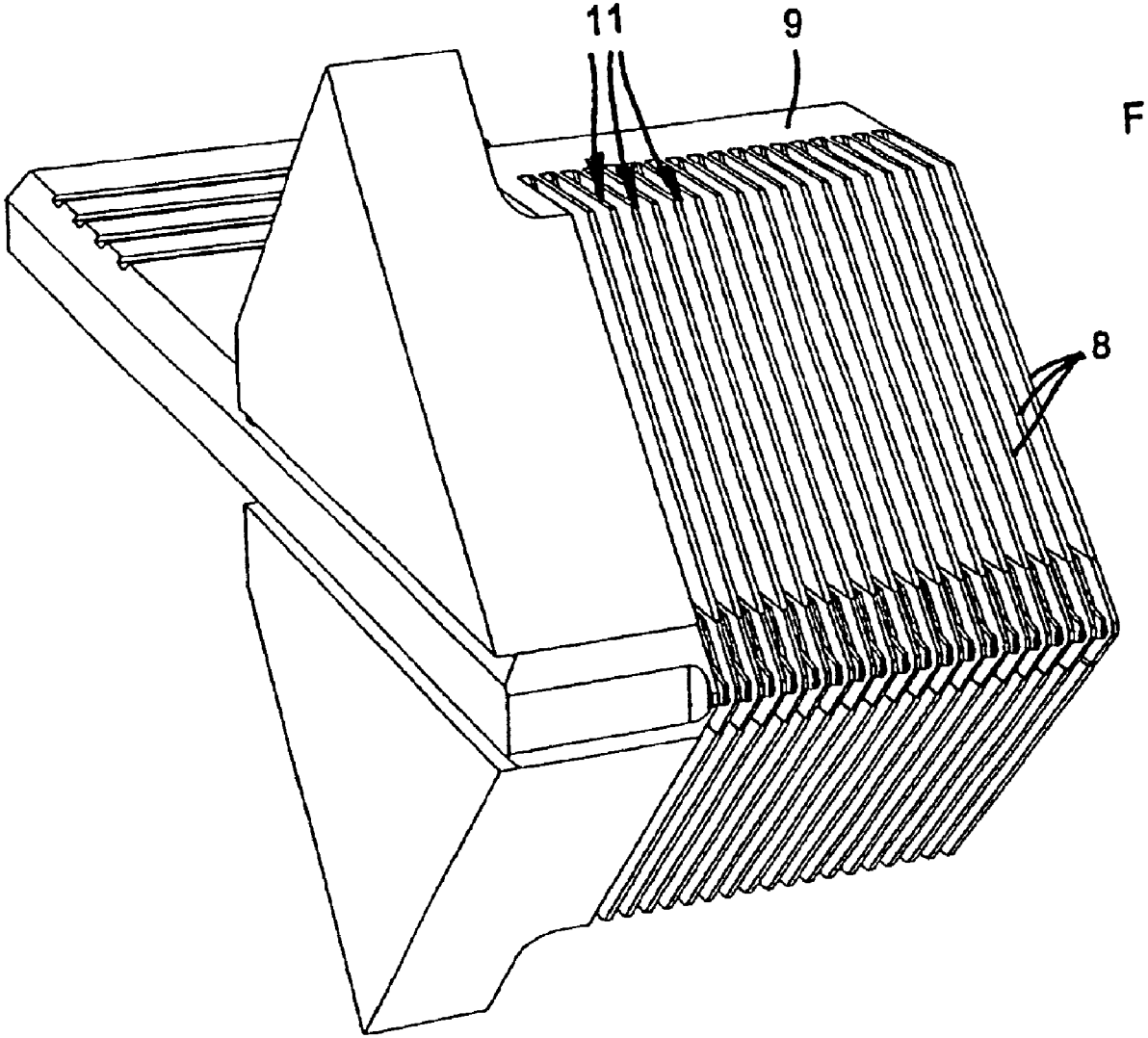
FIG. 4 is a perspective view of the printhead showing supporting bodies attached to each side and, FIG. 5 is a further perspective view showing side covers attached to each of the supporting bodies.
Figure 5:
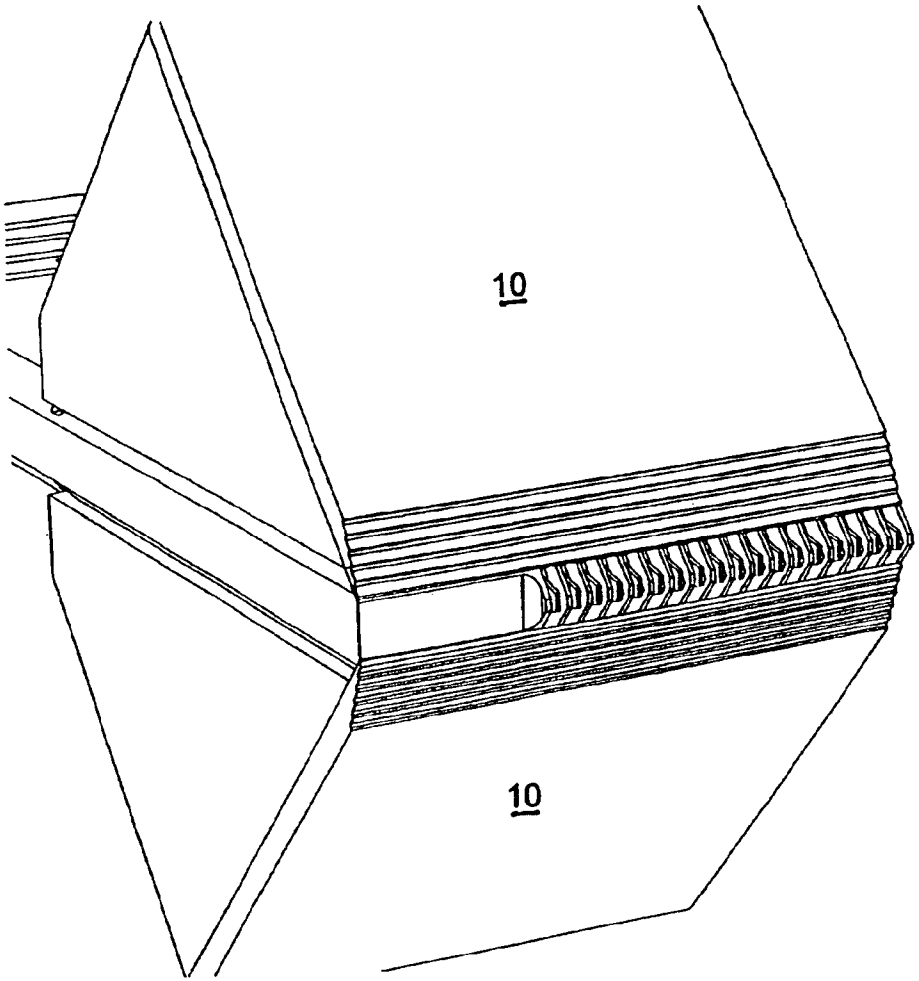

As is best seen in FIG. 4, liquid supply and removal channels 11 which respectively supply and remove liquid from the cells 2 and which in part define the cells 2, are provided between walls 8, integrally formed with one another on a supporting body 9 generally triangular in shape when viewed from the end of the printhead. The walls 8 are disposed in registration with the cell-separating lands 5 in order to define the channels 11 over their whole length. FIG. 5 illustrates side covers 10 which close the channels 11 formed between the walls 8.

The precise shape of the protrusions 4, defining the ejection locations, will depend upon the application, the intended liquid with which the printhead is to be used, its operating conditions etc. In the example shown, the protrusions 4 are simple triangular forms or upstands formed on the front edge of the lands 5, but of lesser thickness. In the example shown, the lands 3, 5, upstands 4, spacers 6, wings 8 and side covers 10 are formed from a ceramic material.

It will be appreciated, that, by providing the electrically conducting tracks or paths 12 along the centre of the printhead (see FIG. 3), well separated from the flow channels 11, the channels are separated from the electrically conducting paths 12 over substantially their whole length, the electrically conducting paths and the channels only being in contact with one another at the ejection locations, ie where the electrically conducting paths 12 provide the electrodes 7.

For a printhead with channels that are 100 $\mu$m wide and with a length of 10 mm each side of the ejection electrode region, the ink flow rate is typically 0.01 $ms^{-1}$ in the centre of the channels. With ejection voltage pulses being of the order of 1000V, if one channel is, on average, driven far more often than its neighbour, a typical electrophoretic electric field of $5\times10^4$ $Vm^{-1}$ will be generated in the ink between the ejection electrodes. A typical value of the electrophoretic force on the particles will be $10^{-13}$ N and the resulting electrophoretic velocities will be around $10^{-5}$ $ms^{-1}$. The flow of ink through the channels will generate a shear force on the particles of $5\times10^{-13}$ N. As this is considerably greater than the electrophoretic force, any particle pushed onto the walls of a channel will be swept along the channel by the flow. This results in particles closest to the channel wall passing the first 20 $\mu$m of each electrode in about 0.1s. The significance of this is that, due to electrostatic screening, it is within the first 20 $\mu$m that particle deposition on the electrode tends otherwise to occur as a result of particles being pushed onto the electrode in that region at a rate of about one layer every 2s. The fact that the particles closest to the channel wall are swept past the first 20 $\mu$m of electrode before another layer of particles is laid down eliminates such particle deposition.

What is claimed is:

1. An ejection apparatus for ejecting material from a liquid at a plurality of ejection locations, the apparatus comprising a printhead having a plurality of channels through each of which liquid flows in use to supply liquid to a respective ejection location at an open end of the channel, and a plurality of channels through each of which liquid flows in use to remove depleted liquid from the respective ejection location at an open end of the channel, wherein each channel is one of a pair of co-operating channels, the two cooperating channels thus having a common end, an ejection electrode disposed at each ejection location and by means of which an electric field is created in use to cause the ejection of material from the liquid, and an electrically conductive path to each ejection electrode for supplying a voltage to the ejection electrode in use, wherein the channels are isolated from one another and separated from the electrically conductive paths over substantially the whole of the length of the electrically conductive paths.

2. Apparatus according to claim 1, wherein the channels have longitudinal axes which are disposed at an angle to one another so that liquid is brought to the ejection location and removed from it from the sides, the electrically conductive paths being provided substantially along a central axis bisecting the axes of the channels.

3. Apparatus according to claim 2, wherein the channels are formed along the edges of a pair of prismatic bodies separate from a component which forms the ejection locations.

4. Apparatus according to claim 1, wherein the individual channels are separated from one another by a plurality of walls and isolation of the individual channels is achieved by closing the tops of the channels over a majority of their length.

5. Apparatus according to claim 4, wherein the individual channels are closed, over a majority of their length, by means of a pair of side covers, each of which is common to all of the channels on a respective side and which engages the walls.

6. Apparatus according to claim 4, wherein, at the open end of the channels, lands separate the ejection locations from one another.

7. Apparatus according to claim 6, wherein protrusions are also defined by lands between the lands which separate individual ejection locations from one another, the protrusions of the ejection location-defining lands being smaller in width and defining, on each side thereof, passages for liquid flow between the ejection location-separating lands.

8. Apparatus according to claim 7, wherein, in order to separate the ejection location-defining lands from the ejection location-separating lands, spacers are provided on the flanks of the ejection location-defining lands at least over most of their length, the separators being formed integrally with the protrusion-defining lands, the channel-separating lands or both.

9. Apparatus according to claim 7, wherein the lands and separators are formed by a component located between prismatic bodies in which the channels are formed.

10. Apparatus according to claim 9, wherein the separators are metallised to provide the electrically conducting paths to the ejection electrodes.

11. An ejection apparatus according to claim 1, wherein each electrically conductive path is disposed so as to be out of contact with the liquid, in use, over substantially the whole of its length.

12. An ejection apparatus according to claim 1, wherein each electrically conductive path is disposed so as to be in contact with the liquid, in use, solely at the region of the corresponding ejection location.

13. An ejection apparatus for ejecting material from a liquid at a plurality of ejection locations, the apparatus comprising a printhead having a plurality of channels through each of which liquid flows in use to supply liquid to a respective ejection location at an open end of the channel, and a plurality of channels through each of which liquid flows in use to remove depleted liquid from the respective ejection location at an open end of the channel, wherein each channel is one of a pair of co-operating channels, the two cooperating channels thus having a common end, an ejection electrode disposed at each ejection location and by means of which an electric field is created in use to cause the ejection of material from the liquid, and an electrically conductive path to each ejection electrode disposed so as to be out of contact with the liquid, in use, over substantially the whole of its length, for supplying a voltage to the ejection electrode in use, wherein the channels are isolated from one another and separated from the electrically conductive paths over substantially the whole of the length of the electrically conductive paths.

14. An ejection apparatus for ejecting material from a liquid at a plurality of ejection locations, the apparatus comprising a printhead having a plurality of channels through each of which liquid flows in use to supply liquid to a respective ejection location at an open end of the channel, and a plurality of channels through each of which liquid flows in use to remove depleted liquid from the respective ejection location at an open end of the channel, wherein each channel is one of a pair of co-operating channels, the two cooperating channels thus having a common end, an ejection electrode disposed at each ejection location and by means of which an electric field is created in use to cause the ejection of material from the liquid, and an electrically conductive path to each ejection electrode disposed as to be in contact with the liquid, in use, solely at the region of the corresponding ejection location for supplying a voltage to the ejection electrode in use, wherein the channels are isolated from one another and separated from the electrically conductive paths over substantially the whole of the length of the electrically conductive paths.

15. An ejection apparatus for ejecting material from a liquid at a plurality of ejection locations, the apparatus comprising a printhead having a plurality of channels through each of which liquid flows in use to or from a respective ejection location at an open end of the channel, each channel being one of two co-operating channels, one of which supplies liquid to a respective ejection location and the other of which removes depleted liquid from the same ejection location, the two cooperating channels thus having a common open end, an ejection electrode disposed at each ejection location and by means of which an electric field is created in use to cause the ejection of material from the liquid, and an electrically conductive path to each ejection electrode for supplying a voltage to the ejection electrode in use; wherein the channels are isolated from one another and separated from the electrically conductive paths over substantially the whole of the length of the electrically conductive paths; and wherein the channels have longitudinal axes which are disposed at an angle to one another so that liquid is brought to the ejection location and removed from it from the sides, the electrically conductive paths being provided substantially along a central axis bisecting the axes of the channels.

16. Apparatus according to claim 15, wherein the channels are formed along the edges of a pair of prismatic bodies separate from a component which forms the ejection locations.

17. Apparatus according to claim 15, wherein the individual channels are separated from one another by a plurality of walls and isolation of the individual channels is achieved by closing the tops of the channels over a majority of their length.

18. Apparatus according to claim 17, wherein the individual channels are closed, over a majority of their length, by means of a pair of side covers, each of which is common to all of the channels on a respective side and which engages the walls.

19. Apparatus according to claim 17, wherein, at the open end of the channels, lands separate the ejection locations from one another.

20. Apparatus according to claim 19, wherein protrusions are also defined by lands between the lands which separate individual ejection locations from one another, the protrusions of the ejection location-defining lands being smaller in width and defining, on each side thereof, passages for liquid flow between the ejection location-separating lands.

21. Apparatus according to claim 20, wherein, in order to separate the ejection location-defining lands from the ejection location-separating lands, spacers are provided on the flanks of the ejection location-defining lands at least over most of their length, the separators being formed integrally with the protrusion-defining lands, the channel-separating lands or both.

22. Apparatus according to claim 20, wherein the lands and separators are formed by a component located between prismatic bodies in which the channels are formed.

23. Apparatus according to claim 22, wherein the separators are metallised to provide the electrically conducting paths to the ejection electrodes.

* * * * *